United States Patent [19]

Brauch et al.

[11] 4,254,637

[45] Mar. 10, 1981

[54] REFRIGERATION SYSTEM WITH REFRIGERANT COOLING OF COMPRESSOR AND ITS OIL

[75] Inventors: Paul J. Brauch, Muskego; Paul G. Szymaszek, Milwaukee, both of Wis.

[73] Assignee: Vilter Manufacturing Corporation, Milwaukee, Wis.

[21] Appl. No.: 86,587

[22] Filed: Oct. 19, 1979

[51] Int. Cl.[3] ..... F25B 43/02

[52] U.S. Cl. ..... 62/468; 62/470; 62/505

[58] Field of Search ..... 62/84, 468, 470, 505

[56] References Cited

U.S. PATENT DOCUMENTS

| | | | |
|---|---|---|---|
| 3,407,623 | 10/1968 | Richardson et al. | 62/505 |
| 3,710,590 | 1/1973 | Kocher | 62/468 |
| 3,721,108 | 3/1973 | Kocher | 62/505 |
| 3,850,009 | 11/1974 | Villadsen | 62/473 |
| 3,859,815 | 1/1975 | Kasahara | 62/505 |
| 3,874,192 | 4/1975 | Kato | 62/473 |
| 4,062,199 | 12/1977 | Kasahara et al. | 62/505 |

*Primary Examiner*—Ronald C. Capossela

*Attorney, Agent, or Firm*—James E. Nilles

[57] ABSTRACT

In a refrigeration system wherein compressed refrigerant flows from a compressor discharge chamber successively through an oil separator and a condenser to a high pressure receiver, a minor portion of the condensed refrigerant that enters the high pressure receiver is passed through a pump by which its pressure is raised to above that of compressed refrigerant at said discharge chamber. From the pump the refrigerant is passed through an oil cooler in indirect heat exchange with compressor lubricating oil and is then released into the discharge chamber where it desuperheats the compressed refrigerant, thereby also cooling the compressor itself and increasing the effectiveness of the oil separator. The rate of flow of such refrigerant through the oil cooler is controlled to maintain a desired temperature of refrigerant flowing from the discharge chamber to the oil separator.

6 Claims, 3 Drawing Figures

REFRIGERATION SYSTEM WITH REFRIGERANT COOLING OF COMPRESSOR AND ITS OIL

FIELD OF THE INVENTION

This invention relates to refrigeration systems of the type that comprise a compressor, a cooler for compressor lubricating oil, a condenser in which refrigerant from the compressor is cooled and condensed, and a high pressure receiver wherein the condensed refrigerant is temporarily stored before being passed through an evaporator at a point of use; and the invention is more particularly concerned with means in such a refrigeration system for causing substantially all heat that must be abstracted from the system to be given off at the condenser and for improving the effectiveness of an oil separator through which refrigerant passes in flowing from the compressor to the condenser.

BACKGROUND OF THE PRIOR ART

In a compressor refrigeration system, a certain amount of the heat energy that is developed at the compressor goes into heating the compressor itself and the oil by which the compressor is lubricated. To cool the oil sufficiently to maintain its lubricating qualities, and also to enable it to effect cooling of the compressor body, the compressor lubricating oil may be circulated through an oil cooler that is external to the compressor and in which the oil is passed in indirect heat exchange relationship with a cooling medium. In large refrigeration systems it has heretofore been conventional to use water as the cooling medium for the oil cooler. In many cases the circulation flow for such cooling water was arranged to include the compressor itself, and particularly its cylinder body, which was provided with a water jacket for the purpose.

Such water cooling of the compressor and its oil supply required a special circuit comprising a source of cooling water and provision for satisfactory disposition of the heated water as well as the necessary ducting and pump. Of course it was also necessary to provide the compressor body with a water jacket that increased the cost and complexity of the compressor. The present invention starts from the recognition that there is an inherent inefficiency in providing special facilities for cooling the compressor and its lubricating oil when there is already present in the refrigeration system a condenser that is intended for rejecting heat energy developed at the compressor.

From time to time others have recognized the anomaly in providing two different facilities for performing what is essentially one and the same function—heat rejection—but heretofore there has been no satisfactory proposal for an arrangement that would rationalize such refrigeration systems by causing all heat that must be abstracted from the compressor and its lubricating oil to be given off at the condenser.

U.S. Pat. No. 3,710,590, to Kocher, discloses a refrigeration system in which lubricating oil for a rotary screw compressor is cooled by indirect heat exchange with refrigerant drawn from the high pressure receiver by means of a pump. According to that patent, the refrigerant used for oil cooling, after being passed through the oil cooler, is sent through a desuperheating coil in an oil separator that is downstream from the compressor; and it is then directed back to the condenser through a duct separate from the duct that carries the compressed refrigerant. This arrangement takes care of cooling the lubricating oil for the compressor, but it does not provide for carrying off excess heat from the compressor itself. Furthermore, it fails to take advantage of a possibility that becomes apparent in the light of the present invention, namely, the employment of the refrigerant that has been passed through the oil cooler to increase the effectiveness of the oil separator.

U.S. Pat. No. 3,874,192, to Kato, discloses a refrigeration system wherein a certain amount of liquid refrigerant, taken from the high pressure receiver, is injected by means of a venturi-type atomizer into the stream of compressed refrigerant flowing from a screw compressor to an oil separator. The atomized liquid refrigerant is said to cool the oil that is entrained in the compressed refrigerant to a temperature of about 45° C. and is said to cool the gas component of the compressed refrigerant "to a temperature in the vicinity of the condensation temperature of the condenser, that is, 30° C. to 35° C." This arrangement effects desuperheating of the compressed refrigerant at the same time that it improves the effectiveness of the oil separator by reason of the condensation of a certain amount of the entrained oil in the stream of compressed refrigerant; and the oil that is returned to the compressor from the oil separator may have a certain amount of effectiveness in cooling the compressor. However, as with the system proposed by Kocher, there is no provision for direct cooling of the compressor itself by means of refrigerant.

U.S. Pat. No. 4,062,199, to Kasahara et al, discloses an arrangement wherein oil that is separated at an oil separator from compressed refrigerant issuing from a screw compressor is passed through an oil cooler before being returned to the screw compressor. In one of the embodiments disclosed in that patent, the oil cooler is cooled by liquid refrigerant drawn from a high pressure receiver. The refrigerant that has been passed through the oil cooler is conducted through a supercooler, in indirect heat exchange with refrigerant that is flowing from the receiver to the evaporator, and then, as a gas at low temperature and intermediate pressure, it is injected into the compressor at an intermediate-pressure zone thereof. This arrangement employs compressed refrigerant for cooling of the compressor and its lubricating oil, thus eliminating the need for a cooling water circuit, but some portion of the capacity of the compressor has to be sacrificed to provide for such oil and compressor cooling.

Other arrangements have been proposed for employing compressed and cooled refrigerant as a medium for cooling the compressor and/or its lubricating oil, but in all such systems heretofore proposed the refrigerant used for that purpose has been returned to the low-pressure side of the compressor (or, as in Kasahara et al, to an intermediate pressure portion of the compressor) so that the compressor has had to recompress such refrigerant at the sacrifice of some of its capacity for compressing refrigerant for the refrigeration system proper. Furthermore, when such refrigerant was returned to the compressor inlet, it cooled only the portion of the compressor body that tended to be coolest anyway, and in being compressed along with the rest of the refrigerant fed into the compressor, it could not remove heat from the hottest parts of the compressor body. Thus prior compressor cooling expedients of this type brought about no real and substantial improvement in the capital cost of equipment needed for providing a given refrigeration capacity, and usually afforded no material improvement in the efficiency of the refrigeration system as a whole.

SUMMARY OF THE INVENTION

The general object of the present invention is to provide a refrigeration system of the character described wherein refrigerant circulating in the system is employed for cooling the reciprocating compressor for the system and the lubricating oil for that compressor, and is employed in such a manner as to improve the efficiency of the oil separator in the system; and wherein these advantages are obtained at a lower capital cost and with a higher system efficiency than prior systems having a separate water circulation system for cooling the compressor and its lubricating oil, but without sacrifice of the refrigeration capacity obtainable with a given compressor.

It is also an object of this invention to improve a refrigeration system wherein an oil separator downstream from a reciprocating compressor serves to separate compressor lubricating oil from compressed refrigerant in which the oil is entrained, the improvement of the system being obtained by cooling the stream of compressed refrigerant before it reaches the oil separator, to desuperheat the compressed refrigerant and at the same time condense a substantial portion of the oil entrained therein, such cooling of the refrigerant stream being effected with refrigerant which has previously been circulated in indirect heat exchange relationship with the compressor lubricating oil and which is so introduced into the stream of compressed refrigerant flowing to the oil separator as to also effect direct cooling of the compressor.

Insofar as the refrigeration system of this invention is conventional, it comprises a refrigerant compressor that has a cylinder head in which there is a discharge chamber, a condenser located substantially remotely from the compressor and through which compressed refrigerant from said discharge chamber flows to be condensed, a high pressure receiver for temporary storage of condensed refrigerant, an oil separator through which compressed refrigerant passes in flowing from the compressor to the condenser, and an oil cooler through which oil for lubrication of the compressor is circulated to be cooled by indirect heat exchange with another fluid. By means of the arrangement of the invention, substantially all heat that is required to be abstracted from the system—including heat that must be removed from the compressor lubricating oil and heat to be directly removed from the compressor itself—is caused to be given off at the condenser. The invention is characterized by means comprising a pump for withdrawing from the high pressure receiver a portion of the condensed refrigerant that flows thereinto from the condenser and for raising the pressure of such withdrawn refrigerant to above the pressure of refrigerant in said discharge chamber; and duct means associated with said pump for passing said portion of refrigerant through said oil cooler to serve as said other fluid by which oil is cooled and thence into said discharge chamber to be mixed with compressed refrigerant therein for cooling of the compressor. There is an expansion valve in said duct means, which controls the rate of flow of said withdrawn portion of refrigeration to maintain substantially a predetermined temperature in compressed refrigerant flowing from the compressor discharge chamber to the oil separator. Mixing of said withdrawn portion of the refrigerant with compressed refrigerant has the further effect of condensing a substantial portion of the oil that is entrained in the compressed refrigerant so that such oil can be readily and substantially completely removed from the refrigerant by the oil separator.

BRIEF DESCRIPTION OF DRAWING

In the accompanying drawings, which illustrate what are now regarded as preferred embodiments of the invention.

DETAILED DESCRIPTION OF PREFERRED EMBODIMENT

Figure 2:
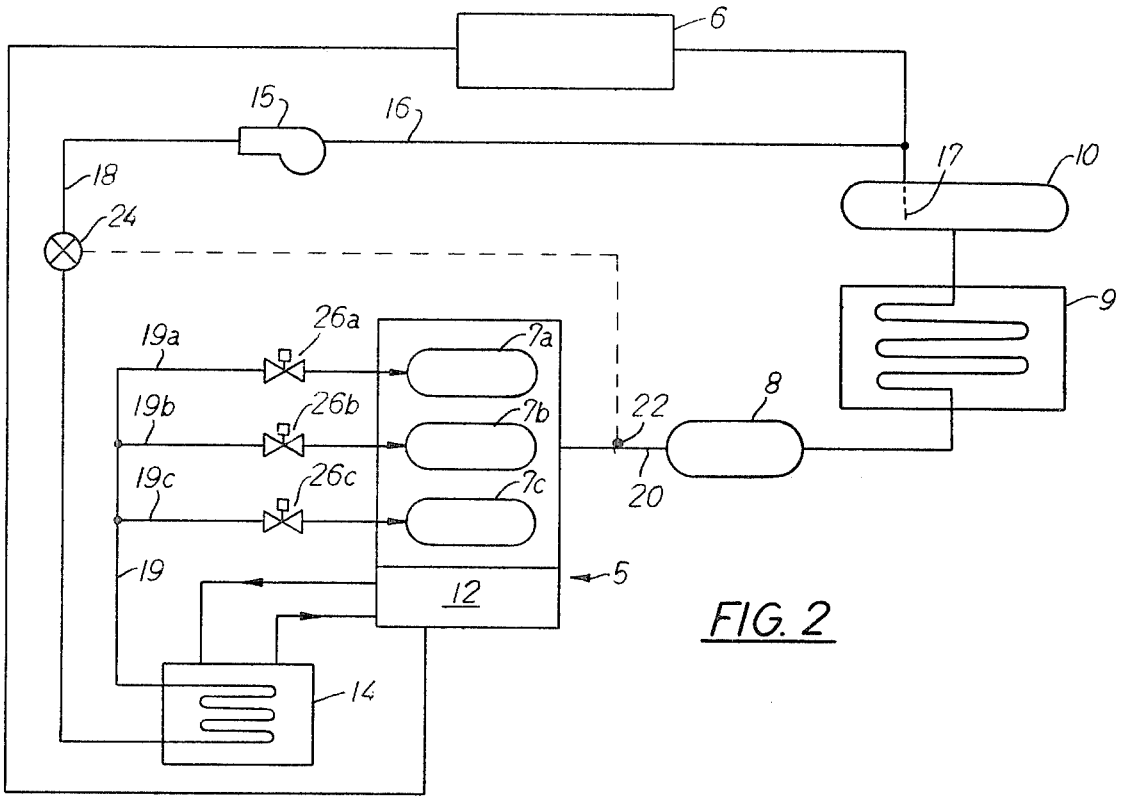
FIG. 2 is a diagram generally similar to FIG. 1 but illustrating a refrigeration system with a modified form of control system.
Figure 3:
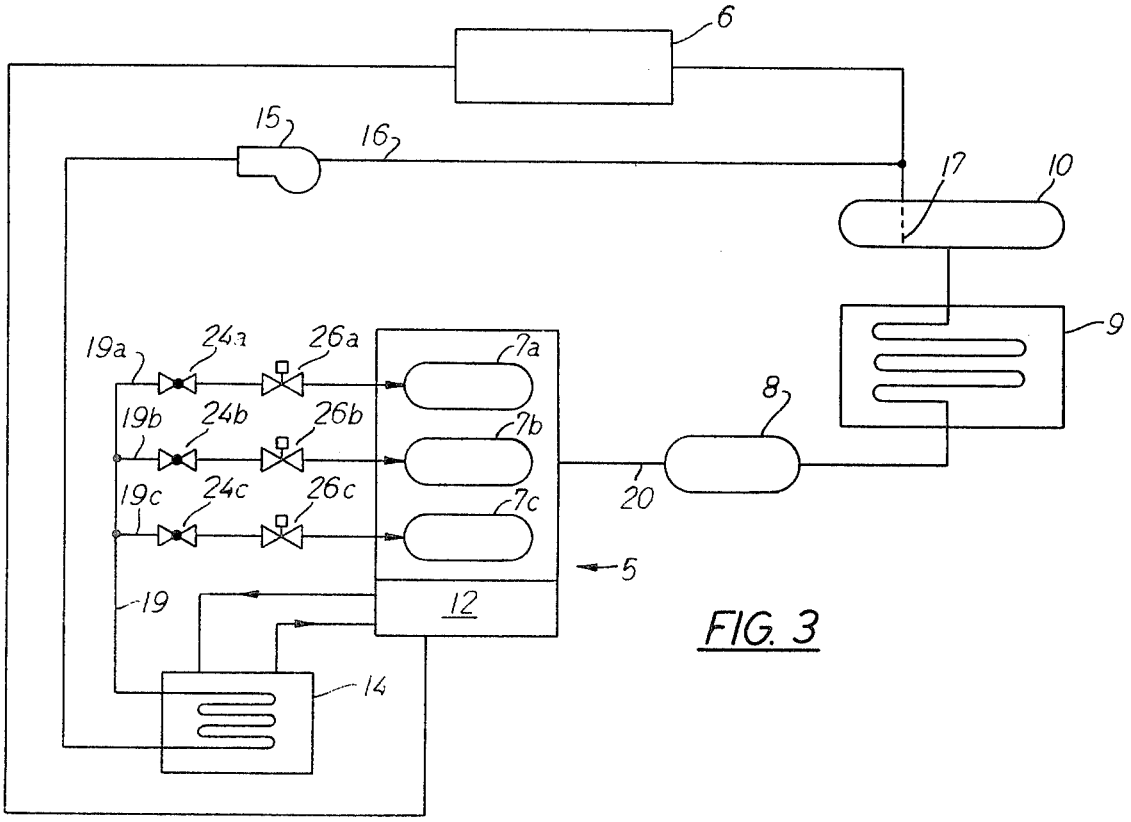
FIG. 3 is a circuit diagram of a refrigeration system according to the invention with another modified form of control system.

Referring now to the accompanying drawings, the numeral 5 designates a reciprocating compressor by which refrigerant returning from an evaporator 6 is compressed. Such a compressor conventionally has a discharge chamber 7 in its cylinder head or in a bank of cylinder heads if it is a multi-cylinder compressor as shown in FIGS. 2 and 3, in which case the discharge chamber 7 serves as a manifold to which the compressed refrigerant is delivered. From the discharge chamber 7 the compressed refrigerant flows sequentially through an oil separator 8 and a condenser 9 to a high pressure receiver 10. The refrigerant flows to the condenser 9 as a superheated compressed gas, and during its passage through the condenser it is cooled by indirect heat exchange with a cooling medium which can be outside air or cooling water. During the first part of its flow through the condenser 9 the compressed refrigerant gas is desuperheated, that is, it is cooled from substantially the temperature at which it leaves the compressor 5 to the saturation temperature at which it passes into the liquid phase at the prevailing pressure. Thereafter, and during most of its flow through the condenser 9, it gives off latent heat and condenses to a liquid that is temporarily stored in the high pressure receiver 10. As the liquid refrigerant from the high pressure receiver 10 flows through the evaporator 6, it takes up heat and is converted back to the vapor phase, thus performing the refrigerating function. From the evaporator 6 the refrigerant vapor is drawn to the suction chamber 12 of the compressor 5 to be compressed for another cycle.

The work done by the compressor 5 in compressing the refrigerant is manifested as heat in the compressed refrigerant and in heating of the body of the compressor itself and of the lubricating oil in its crankcase. In order to cool the lubricating oil, it is circulated through an oil cooler 14 which is external to the compressor and in which the oil is passed in indirect heat exchange relationship with a coolant fluid. Heretofore, as explained above, water has conventionally been employed as the oil cooling medium; but according to the principles of the present invention, oil cooling is effected by means of liquid refrigerant that is withdrawn from the high pressure receiver 10 by means of a pump 15.

A duct 16 that connects the inlet of the pump 15 with the high pressure receiver 10 has its inlet 17 near the bottom of the high pressure receiver to ensure that only liquid refrigerant will be drawn into the pump. From the outlet of the pump 15 the withdrawn liquid refrigerant is conducted to the oil cooler 14 by means of another duct 18, and the refrigerant that has been passed through the oil cooler is further conducted from it to the compressor discharge chamber 7 by means of still another duct 19.

Figure 1:
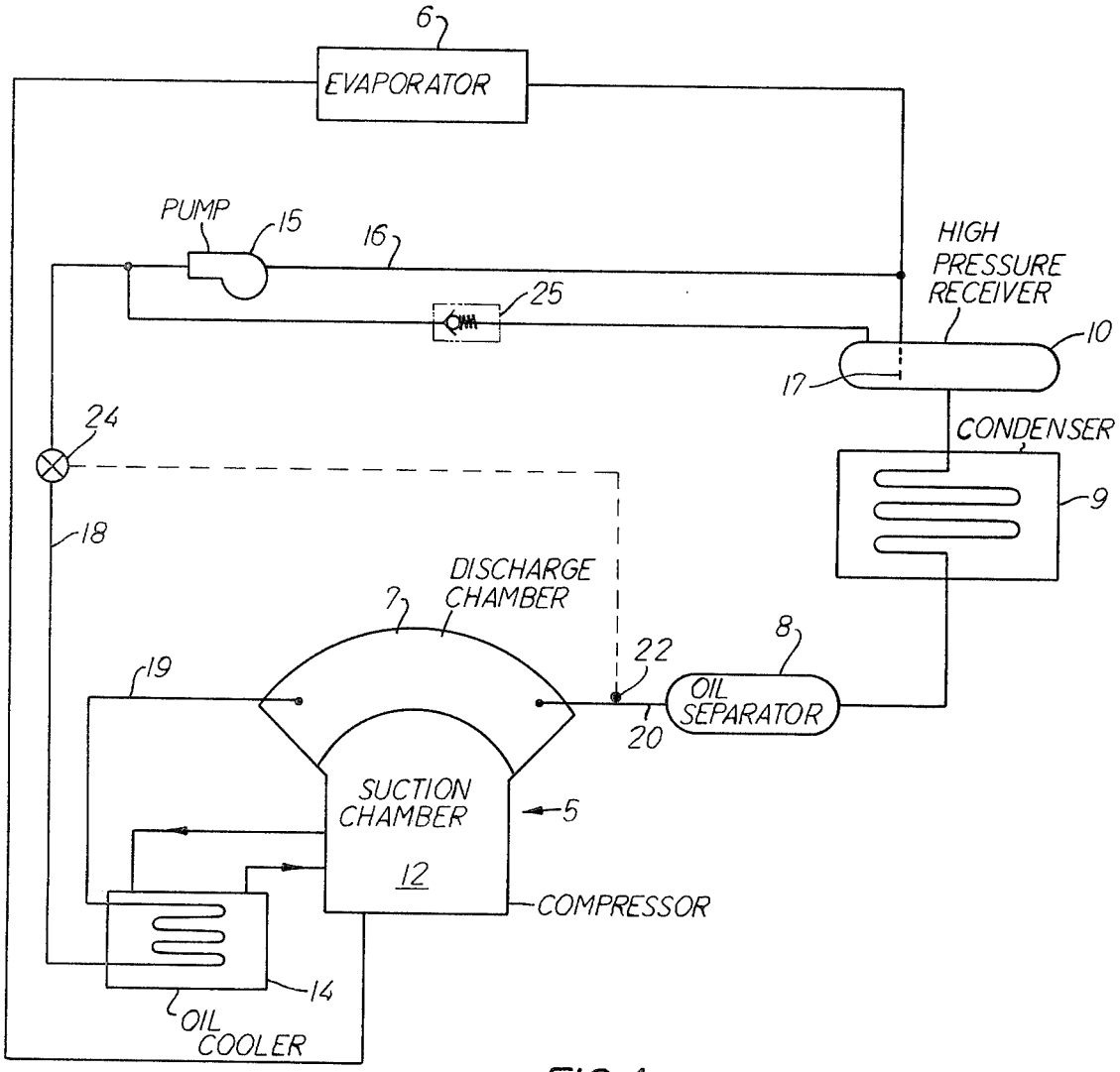
FIG. 1 is a diagram of the circuit of a refrigeration system according to the invention.

The pump 15 can be a relatively small one because the amount of liquid refrigerant that it withdraws from the high pressure receiver 10 and diverts to the oil cooler 14 is small in comparison with the amount available to the evaporator 6. By way of example, a $\frac{5}{8}$ HP pump 15 is adequate for a system having a 100 HP compressor 5. Since the quantity of withdrawn refrigerant to be pumped through the duct means 18 and 19 may vary from time to time as explained hereinafter, the pump 15 may have a relief valve 25 connected across it as shown in FIG. 1, or it may be of other than the positive displacement type (e.g., a centrifugal pump), in which case the relief valve can be omitted as in the examples illustrated in FIGS. 2 and 3.

It is significant to the invention that the pressure of refrigerant at the outlet of the pump 15 is higher than the pressure of compressed refrigerant in the discharge chamber 7 of the compressor 5, and therefore the pumped refrigerant can flow through the oil cooler 14 and into the compressor discharge chamber 7 against the pressure of compressed refrigerant in that chamber.

The temperature of the liquid refrigerant withdrawn from the high pressure receiver 10 by the pump 15 is no higher than the saturation temperature of the refrigerant, and it is heated only insignificantly by the pump 15. Since compressor lubricating oil may enter the oil cooler 14 at temperatures substantially higher than that of the refrigerant circulated by the pump 15, that refrigerant is capable of picking up a substantial amount of heat from the oil being circulated through the oil cooler 14 and can cool that oil satisfactorily. In passing through the oil cooler 14, a certain amount of the pumped refrigerant may be converted to the gaseous phase, but most of it will be fed to the compressor discharge chamber 7 as a liquid.

Upon entering the compressor discharge chamber 7 from the duct 19, the refrigerant that has been passed through the oil cooler 14 will be entirely converted to the vapor phase as it mixes with the compressed gaseous refrigerant in the discharge chamber and absorbs heat therefrom. In thus desuperheating the compressed refrigerant in the compressor discharge chamber 7, the incoming refrigerant will also cool the compressor itself. It will be observed that the part of the compressor body from which heat is most directly taken up by this incoming refrigerant is that at which temperatures tend to be highest, that is, the upper portions of the cylinders. In a typical case, the temperature of the compressed refrigerant in the compressor discharge chamber is brought down from 250° F. to 150° F., with a corresponding cooling of the compressor body.

At this point in the explanation it will be apparent that the present invention eliminates the need for a separate water cooling system for the compressor body and the compressor oil cooler 14, and that the liquid refrigerant pump 15 of this invention costs no more and consumes no more energy than the cooling water pump that it can be considered to replace.

However, the present invention provides a further and unexpected advantage not attainable with a water cooling system. When the pumped refrigerant from the duct 19 enters the compressor discharge chamber 7 and substantially lowers the sensible temperature of the compressed refrigerant in that chamber, it thereby also causes condensation of a substantial amount of vaporized oil that became entrained in the compressed refrigerant during its passage through the compressor. Since such condensation occurs before the compressed refrigerant reaches the oil separator 8, the droplets of condensed oil are readily picked up in the oil separator 8, which thus performs its function much more effectively than the oil separators of heretofore conventional refrigeration systems.

Refrigerant that has passed through the oil cooler 14 is conducted into the discharge chamber 7 of the compressor 5, rather than to the low pressure side of the compressor as in some prior systems, and therefore the compressor is required to work on refrigerant that is returned to it from the evaporator 6. This is to say that when the cooling arrangement of this invention is incorporated in a refrigeration system that comprises a given compressor, the refrigeration capacity obtainable with that compressor is in no wise diminished by the invention. The mechanical energy required for cooling the oil and the compressor body is of course supplied at the pump 15, but since the power consumption of that pump compares favorably with that of the water pump in heretofore conventional refrigeration systems, there is a significant net saving in the conservation of water and in the elimination of cooling water plumbing. It will also be observed that because of the desuperheating that takes place at the compressor discharge chamber 7 in the system of this invention, the condenser 9 can be the equivalent of that in a heretofore conventional system of like refrigeration capacity.

In general, the rate at which the pump 15 withdraws liquid refrigerant from the high pressure receiver 10 and sends it through the oil cooler 14 and to the compressor discharge chamber 7 determines the temperature to which oil will be cooled at the oil cooler 14 and also determines the temperature to which refrigerant in the compressor discharge chamber 7 will be cooled. Desirably, oil leaving the oil cooler 14 should be at a temperature of about 100° to 130° F., and refrigerant issuing from the compressor discharge chamber 7 should be at about 130° to 150° F. It will usually be satisfactory to monitor the temperature of refrigerant flowing in the duct 20 between the compressor discharge chamber 7 and the oil separator 8 and so control the rate of flow of refrigerant through the oil cooler 14 as to maintain that monitored temperature at a substantially constant value on the order of 130° F.

The arrangement illustrated in FIG. 1 is intended to be used in a system wherein the compressor 5 does not cycle on and off and wherein the pump 15 is turned on and turned off simultaneously with the compressor. In this case a temperature sensor 22 is located in the duct 20 between the compressor discharge chamber 7 and the oil separator 8, and there is a thermostatically controlled expansion valve 24 in the duct 18 that is responsive to the temperature sensed by the sensor 22. With rising temperatures at the thermostatic sensor 22, the expansion valve 24 opens to permit more refrigerant to flow from the pump 15 through the oil cooler 14 and into the compressor discharge system. To the extent that the pump tends to force more refrigerant towards the oil cooler than the expansion valve 24 will pass, the excess refrigerant is recirculated back around the pump by the relief valve 25.

FIG. 2 illustrates a system in which the compressor comprises a multiplicity of cylinders arranged in three banks, with a discharge chamber *7a, 7b, 7c* for each bank of cylinders. The duct 19 that conducts refrigerant from the oil cooler 14 to the compressor discharge chamber has three branches 19*a*, 19*b* and 19*c*, one branch for each of the respective discharge chambers *7a, 7b, 7c*. In this case the compressor is intended to be shut down cylinder-by-cylinder to accommodate refrigeration load demands, and there is a solenoid valve 26*a*, 26*b*, 26*c* in each of the respective duct branches 19*a*, 19*b*, 19*c* whereby flow of refrigerant to a discharge chamber *7a, 7b* or *7c* can be cut off when its bank of compressor cylinders is shut down. The rate of flow of refrigerant through the oil cooler 14 and to the discharge chambers is again controlled by a thermostatic expansion valve 24 in the duct 18 between the pump 15 and the oil cooler 14, said expansion valve being responsive to a temperature sensor 22 in the duct 20 ahead of the oil separator. The pump 15 is in this case assumed to be a centrifugal pump or the like so that a relief valve is not needed in conjunction with it.

The arrangement illustrated in FIG. 3 is intended for a system in which the compressor load is substantially constant, as for example a booster system. In this case again the duct 19 has three branches 19*a*, 19*b*, 19*c*, one for each of the compressor discharge chambers *7a, 7b, 7c*, and each of the duct branches has a solenoid valve 26*a*, 26*b*, 26*c* to provide for cut-off of flow of refrigerant into a discharge chamber when the bank of cylinders for that discharge chamber is shut down. In series with each of the solenoid valves is a manually adjustable expansion valve 24*a*, 24*b*, 24*c*, each of which is adjusted as necessary to maintain a desired temperature in the compressor discharge chamber *7a, 7b, 7c* fed from its branch duct.

From the foregoing description taken with the accompanying drawing it will be apparent that this invention provides improvements in a mechanical compressor refrigeration system whereby the heretofore conventional cooling water circuit is eliminated and the compressor body and compressor lubricating oil are efficiently cooled by refrigerant in such a manner as to increase the effectiveness of the oil separator in the system.

We claim:

1. In a refrigeration system comprising a refrigerant compressor that has a head wherein there is a discharge chamber through which compressed refrigerant issues from the compressor, a condensor located substantially remotely from the compressor and through which refrigerant from said discharge chamber flows to be cooled, a high pressure receiver for temporary storage of refrigerant that has passed through the condensor, and an oil cooler through which oil for lubrication of the compressor is circulated to be cooled by indirect heat exchange with another fluid, means for causing substantially all heat that is required to be abstracted from the system to be given off at the condenser, said means comprising:

A. means comprising a pump for withdrawing from the high pressure receiver a portion of the refrigerant that flows thereinto from the condenser and for raising the pressure of such withdrawn refrigerant to above the pressure of refrigerant in said discharge chamber; and B. duct means associated with said pump for passing said portion of refrigerant (1) through said oil cooler to serve as said other fluid by which oil is cooled and (2) thence into said discharge chamber to be mixed with compressed refrigerant therein for cooling of the compressor.

2. The refrigeration system of claim 1, further characterized by:

C. expansion valve means in said duct means for controlling the rate of flow of said portion of refrigerant therethrough; and D. means for adjusting said expansion valve means in accordance with temperature of refrigerant issuing from the discharge chamber, whereby said rate of flow can be increased substantially in correspondence with increase in said temperature.

3. A refrigeration system wherein refrigerant compressed by a compressor flows from a discharge chamber in the compressor successively through an oil separator in which entrained compressor lubricating oil is removed from the refrigerant and a condenser in which the refrigerant is cooled and condensed, to a high pressure receiver in which the condensed refrigerant is temporarily stored, and wherein compressor lubricating oil is circulated through an oil cooler to be cooled by indirect heat exchange with a cooling medium, said refrigeration system being characterized by:

A. means comprising a pump for withdrawing from the high pressure receiver a portion of the refrigerant flowing thereto and for discharging such withdrawn refrigerant at a pressure higher than that which prevails in said discharge chamber;

B. means connected between said pump and the oil cooler for passing through the oil cooler, in indirect heat exchange with oil circulated therethrough, the refrigerant discharged from the pump; and C. means connected between the oil cooler and the discharge chamber of the compressor for feeding into said discharge chamber the refrigerant that has been passed through the oil cooler, so that the residual cooling value of that refrigerant cools the compressor and also cools refrigerant flowing from the discharge chamber to the oil separator to increase the separating efficiency thereof.

4. A refrigeration system comprising an oil-lubricated compressor having a discharge chamber that normally contains compressed refrigerant under pressure, an oil separator through which compressed refrigerant passes in flowing from said discharge chamber to a condenser, and a high pressure receiver for temporary storage of condensed refrigerant that has passed through the condenser, said refrigeration system being characterized by:

A. a pump having (1) an inlet connected with said high pressure receiver for withdrawing therefrom a minor portion of the condensed refrigerant that enters the high pressure receiver from the condenser and (2) an outlet at which such withdrawn refrigerant is at a higher pressure than prevails in said discharge chamber; and B. means comprising duct means connected with said outlet for directing refrigerant from said outlet into said discharge chamber so that compressed refrigerant in said discharge chamber and flowing therefrom is substantially desuperheated by refrigerant from the outlet of the pump and oil entrained in such compressed refrigerant is substantially condensed to be effectively removed at the oil separator.

5. The refrigeration system of claim 4, wherein there is an oil cooler external to the compressor and through which oil that lubricates the compressor is circulated in indirect heat exchange relationship with a cooling medium, further characterized by:

said means comprising duct means further comprising said oil cooler, through which said withdrawn refrigerant passes as a cooling medium in flow from said outlet to the discharge chamber.

6. A refrigeration system of the type having an oil lubricated compressor in which there is a discharge chamber from which compressed refrigerant flows through an oil separator and thence through a condenser to a high pressure receiver in which condensed refrigerant is temporarily stored, and wherein condensed refrigerant from said high pressure receiver is passed through an oil cooler in indirect heat exchange relationship with compressor lubricating oil to cool the same, said refrigeration system being characterized by:

A. a pump having an inlet communicated with said high pressure receiver and an outlet which is communicated with said oil cooler and at which the pressure of refrigerant withdrawn from the high pressure receiver is higher than the pressure of compressed refrigerant in said discharge chamber; and B. means communicating the oil cooler with said discharge chamber so that refrigerant which has passed through said pump and the oil cooler is discharged into the discharge chamber for desuperheating of compressed refrigerant, cooling of the compressor and condensation of oil entrained in the compressed refrigerant so that such oil is readily picked up in the oil separator.

* * * * *